US005800641A

United States Patent [19]

Schaeffler

[11] Patent Number: 5,800,641

[45] Date of Patent: Sep. 1, 1998

[54] METHOD OF THERMAL OR THERMOCHEMICAL TREATMENT OF PRECISION STEEL COMPONENTS

[75] Inventor: E.H. Georg Schaeffler, Herzogenaurach, Germany

[73] Assignee: Ina Walzlager Schaeffler KG, Germany

[21] Appl. No.: 617,363

[22] Filed: Mar. 18, 1996

[30] Foreign Application Priority Data

Jul. 11, 1995 [DE] Germany ..... 195 25 218.7

[51] Int. Cl.[6] ..... C21D 6/04

[52] U.S. Cl. ..... 148/578; 148/639; 148/644; 148/902

[58] Field of Search ..... 148/578, 639, 148/644, 902

[56] References Cited

U.S. PATENT DOCUMENTS 5,259,200 11/1993 Kamody ..... 148/578

FOREIGN PATENT DOCUMENTS 3018454 11/1980 Germany ..... 148/578
80/00227 9/1981 WIPO .
81/02586 9/1981 WIPO .

*Primary Examiner*—Sikyin Ip
*Attorney, Agent, or Firm*—Bierman, Muserlian and Lucas

[57] ABSTRACT

A method of thermal or thermochemical treatment of precision steel components having different wall thicknesses comprising the steps of a) hardening (8), b) low temperature cooling (9) and c) annealing (10), wherein the precision steel components are subjected to a low temperature cooling of only selected parts of the precision steel component to effect a reduction in the occurrence of primary residual austenite in the selected parts thereof.

5 Claims, 2 Drawing Sheets

METHOD OF THERMAL OR THERMOCHEMICAL TREATMENT OF PRECISION STEEL COMPONENTS

STATE OF THE ART

Such methods have been known for quite a long time and are used with the aim of obtaining desired properties in the steel alloy by the production of different phases and parts of phases, by phase transformation and complete or partial carbide decomposition. Thus, for example, a high hardness is obtained by martensite formation. It is known in this connection, for example, to heat treat precision components by first subjecting them to a hardening treatment which is followed by low temperature cooling and subsequent annealing. (Technologie der Wärmebehandlung von Stahl, VEB Deutscher Verlag für Grundstoffindustrie, Leipzig 1987, Page 238 ff). The low temperature treatment is used for reducing the content of residual austenite because this being a relatively soft structural constituent reduces the hardness of the quenched microstructure.

A disadvantage of this method is that it cannot be used, or can be used only under certain conditions, on precision components having different wall thicknesses. In effect, the low temperature treatment affects the entire component, i.e. not only the regions of larger wall thickness but also those of substantially smaller wall thickness.

Thus, for example, it is possible that the thick-walled parts of precision components having different wall thicknesses possess a residual austenite content which has an unfavorable effect from the tribological point of view while the residual austenite content of the thin-walled parts is tribologically uncritical. If such a component is subjected as a whole to a low temperature treatment, a martensitic transformation with its known unfavorable consequences such as the embrittlement of the entire cross-section or the development of an unfavorable residual stress curve over the cross-section, would take place even in the thin-walled parts of the component depending on the depth of the residual austenite present which in some cases can reach into the core region. The thin-walled parts would then be rather sensitive to fracture and susceptible to cracking.

OBJECTS OF THE INVENTION

It is an object of the invention is to provide an improved method of thermal or thermochemical treatment of precision steel components having different wall thicknesses so that the mechanical properties of their thin-walled regions are not influenced by an undesired transformation of residual austenite.

This and other objects and advantages of the invention will become obvious from the following detailed description.

THE INVENTION

The novel method of the invention for thermal or thermochemical treatment of precision steel components having different wall thicknesses comprises the steps of a) hardening (8), b) low temperature cooling (9) and c) annealing (10) the steel components, characterized in that the precision steel components are subjected to a partial low temperature cooling to effect a reduction in the occurrence of primary residual austenite in the treated parts thereof.

The fact that the precision components are subjected to a partial low temperature cooling results in the reduction of the primary residual austenite occurring preferably at the points treated. This procedure assures that a transformation of the existing residual austenite cannot take place in the non-treated parts, i.e. the ductility of these regions is not reduced and they are therefore less sensitive to fracture.

According to a further development of the invention, the desired low temperature is applied to the functional surfaces.

Functional surfaces means the surfaces which, because of a too high residual austenite content, have unfavorable mechanical or tribological properties.

The low temperature treatment is carried out in a temperature range lying between −35° and −120° C. These guide values are known from pertinent literature.

In a further feature of the invention, the precision components are heated to ambient temperature immediately following the low temperature treatment. This heating to ambient temperature is intended to prevent a heat flow from the warmer part (thin-walled region) to the colder part (thick-walled region). If, namely, such an equalization of temperature took place, the thin-walled region of the precision component would be cooled by the heat flow and undergo an undesired transformation of residual austenite.

In a preferred embodiment of the invention, the low temperature treatment follows immediately after the hardening treatment, i.e. after quenching. Otherwise, there exists the danger of a stabilization of the residual austenite taking place due to a storage time between quenching and the beginning of the low temperature treatment.

In a further embodiment of the invention, the bottom of a cup tappet is subjected to the low temperature treatment. By the thus caused transformation of a part of the relatively soft residual austenite into martensite, the abrasive wear between the cam and the bottom of the cup tappet is decisively reduced, i.e. the operating life of the friction pairing, cam/bottom, is increased while, due to the missing transformation of the residual austenite in the cylindrical wall of the cup, its fracture sensitiveness is not unfavorably influenced.

Figure 1:
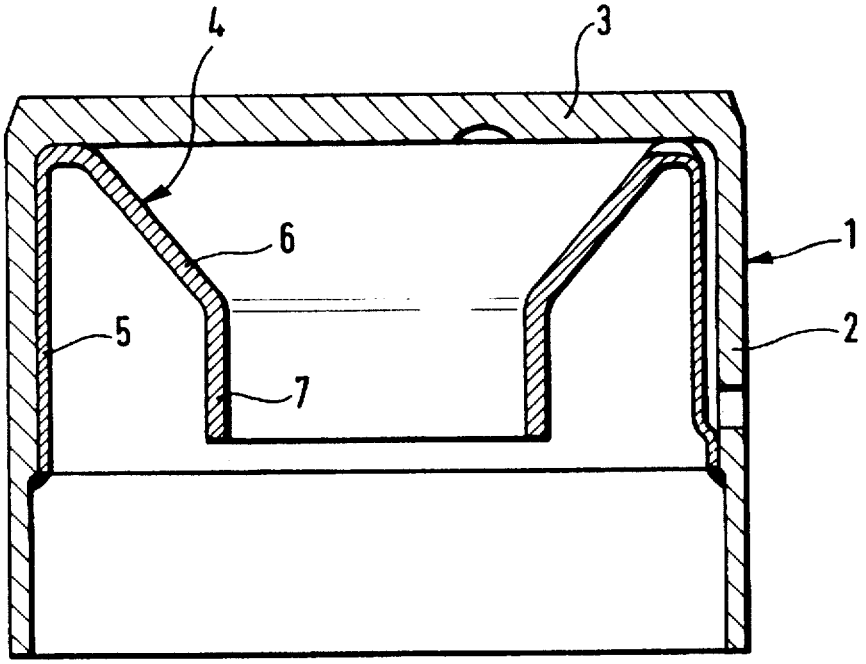
FIG. 1 is a longitudinal section through a tappet construction.

In the tappet construction shown in FIG. 1, a first cup-shaped part 1 is formed by a cylindrical wall 2 and a closed bottom 3. A second part 4 in the form of an M-shaped funnel having a cylindrical outer wall 5 is inserted into the first cup-shaped part 1 and fitted into the bore of the cylindrical wall 2. At its end adjacent the bottom 3 of the first part 1, the cylindrical outer wall 5 merges with a frustoconical region 6 facing away from the bottom 3 and merging in its turn into a cylindrical region 7 facing away from the bottom 3. This cylindrical region 7 serves to lodge the inner tappet element. As can further be seen from FIG. 1, the cup tappet 1 represented therein has different wall thicknesses. The bottom 3, in particular, is thicker than the other parts because its outer surface is contacted by the cam and therefore a high wear resistance is required of this part of the bottom 3. Compared to this, the part of the cylindrical wall 2 remote from the bottom 3 has a reduced cross-sectional area. This is also true for the cylindrical outer wall 5 of the funnel 4. It can easily be understood that in a heat treatment according to the prior art, the low temperature cooling would affect all the regions of the cup 1 so that residual austenite would also be transformed where this is not desirable, i.e. in the region of the cylindrical wall 2.

Figure 2:
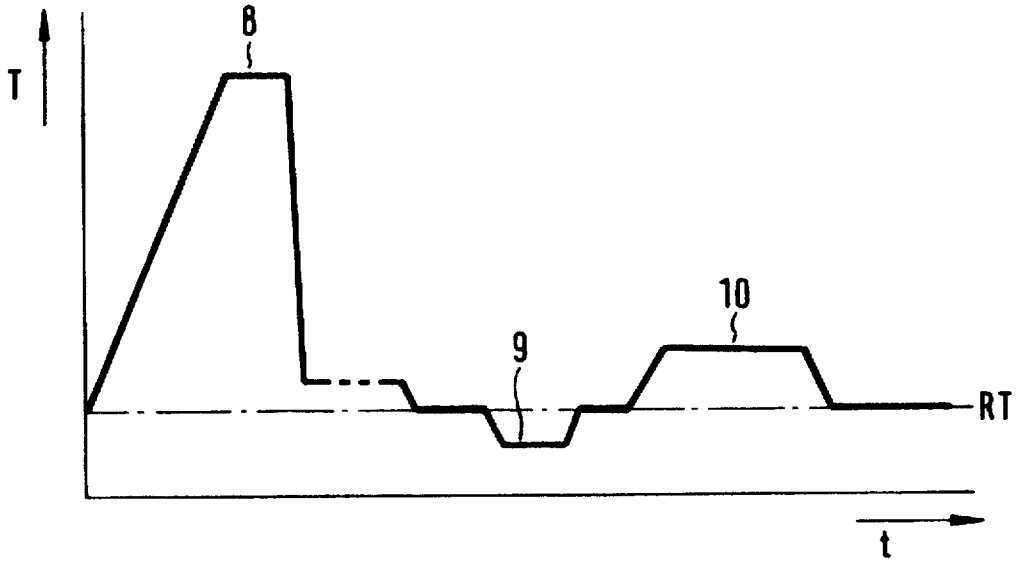
FIG. 2 shows the time-temperature ratios in one method of heat treatment of the aforesaid tappet.
Figure 3:
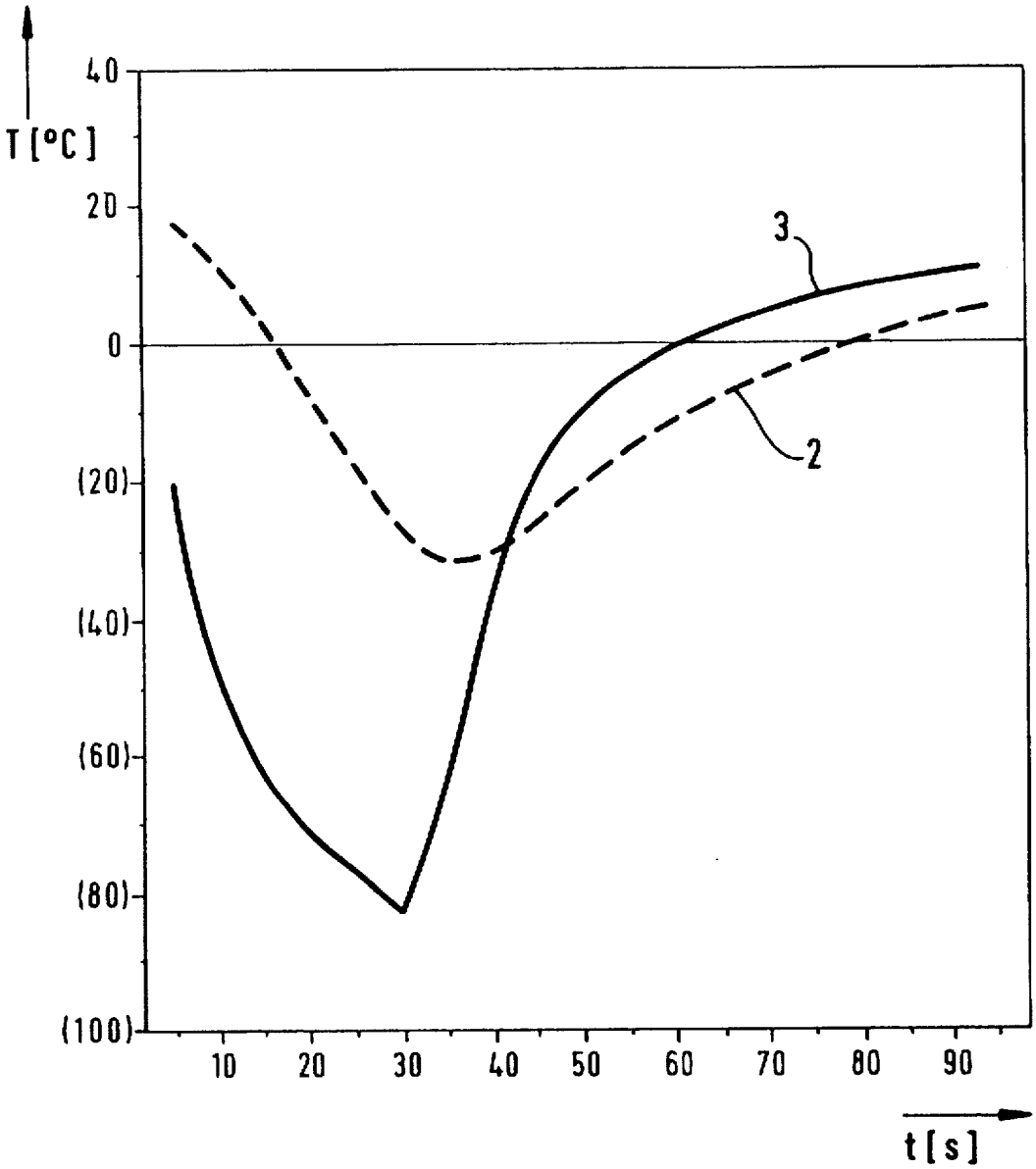
FIG. 3 shows the temperature distribution on the housing bottom and the cylindrical wall of the tappet construction of FIG. 1.

FIG. 2 is a schematic representation of one possible method of thermal treatment which consists of the steps of hardening 8, low temperature cooling 9 and annealing 10. The outer surface of the bottom 3 of the cup tappet 1 represented in FIG. 1 was placed on a copper plate cooled to −196° C. Due to the large temperature difference of 210° C. between the cup tappet 1 and the copper plate and also because of the high specific heat capacity of copper, the bottom 3 cooled down very rapidly. As can be seen particularly in FIG. 3, a temperature difference of approximately 50° to 70° C. was obtained between the bottom 3 and the upper end of the cylindrical wall 2. The housing bottom was left on the copper plate for about 30 seconds and the cup tappet 1 was then placed on a copper plate having a temperature of 20° C. As can be seen in FIG. 3, different temperature curves are obtained for the bottom 3 and the cylindrical wall 2 so that the transformation of residual austenite in the cylindrical wall 2 is substantially reduced as compared to the bottom 3. The low temperature cooling was sufficient to reduce the residual austenite in the bottom 3 from about 50% to about 20%. A further reduction of the residual austenite to values below 20% was obtained by subsequent annealing.

With the method of partial low temperature treatment of the cup tappet as provided by the invention, the desired favorable conditions are obtained, viz., the reduction of the residual austenite content, starting with the largest reduction in the bottom 3 becomes progressively smaller in the direction of the open end of the cup so that, while the tribological conditions between the cam and the bottom 3 are improved, the thin-walled cup skirt 2, because of being affected only to the smallest possible extent, is not subject to any danger of fracture or to a particular susceptibility to cracking.

Various modifications of the method of the invention may be made without departing from the spirit or scope thereof and it should be understood that the invention is intended to be limited only as defined in the appended claims.

What I claim is:

1. A method of thermal or thermochemical treatment of precision steel components having different wall thicknesses comprising the steps of a) hardening (8), b) low temperature cooling (9) and c) annealing (10), providing the precision steel components of selected thicker parts of cup tappet (1) are subjected to a partial low temperature cooling so that a reduction of primary residual austenite occurs in the said selected thicker parts.

2. The method of claim 1 wherein the desired low temperature is applied to the bottom (3) of the cup tappet.

3. The method of claim 1 wherein the low temperature cooling (9) is carried out between −35° C. and −120° C.

4. The method of claim 1 wherein the cup tappet is heated to ambient temperature immediately after the low temperature cooling (9).

5. The method of claim 1 wherein the hardening (8), is followed immediately by low temperature cooling (9).

* * * * *